US009865971B2

(12) United States Patent
Garcia

(10) Patent No.: US 9,865,971 B2
(45) Date of Patent: Jan. 9, 2018

(54) RECONFIGURABLE RECESSED ELECTRICAL CONDUIT RECEPTACLES

(71) Applicant: Manuel Jose Garcia, Las Vegas, NV (US)

(72) Inventor: Manuel Jose Garcia, Las Vegas, NV (US)

( * ) Notice: Subject to any disclaimer, the term of this patent is extended or adjusted under 35 U.S.C. 154(b) by 0 days.

(21) Appl. No.: 14/121,394

(22) Filed: Aug. 30, 2014

(65) Prior Publication Data

US 2016/0064876 A1 Mar. 3, 2016

(51) Int. Cl.

| | |
|---|---|
| ***H01R 13/60*** | (2006.01) |
| ***H01R 13/74*** | (2006.01) |
| *H01R 13/514* | (2006.01) |
| *H01R 24/38* | (2011.01) |
| *H01R 24/66* | (2011.01) |

(52) U.S. Cl.

CPC ..... *H01R 13/74* (2013.01); *H01R 13/748* (2013.01); *H01R 13/514* (2013.01); *H01R 24/38* (2013.01); *H01R 24/66* (2013.01)

(58) Field of Classification Search

CPC ..... H01R 25/006; H01R 23/025; H01R 33/7628; H01R 23/7063; H01R 23/7057; H01R 12/7052; H01R 23/7042; H02G 3/20; H02G 3/123; H02G 3/18; H02G 3/14; H02G 3/185; H02G 3/16; H02G 3/126; H02G 3/0616; B60R 11/0205

USPC ..... 439/535–538, 569–573; 248/27.1, 27.3, 248/906; 174/53–64

See application file for complete search history.

(56) References Cited

U.S. PATENT DOCUMENTS

| | | | | | |
|---|---|---|---|---|---|
| 1,829,776 | A * | 11/1931 | Wright | H02G 3/126 | 174/61 |
| 2,665,865 | A * | 1/1954 | Bell | H02G 3/123 | 248/27.1 |
| 2,753,141 | A * | 7/1956 | Weber | H02G 3/121 | 248/27.1 |
| 2,812,149 | A * | 11/1957 | Appleton | H02G 3/123 | 248/231.41 |
| 3,476,343 | A * | 11/1969 | Burrell | H02G 3/123 | 174/58 |
| 4,063,660 | A * | 12/1977 | Ware | H02G 3/123 | 174/58 |
| 4,120,473 | A * | 10/1978 | Suk | H02G 3/123 | 220/3.5 |
| 4,688,596 | A * | 8/1987 | Liebmann | A47L 5/38 | 137/360 |
| 4,693,438 | A * | 9/1987 | Angell | H02G 3/123 | 174/58 |
| 5,609,414 | A * | 3/1997 | Caluori | F21S 8/02 | 248/27.1 |
| 6,871,827 | B2 * | 3/2005 | Petak | H02G 3/12 | 174/58 |

(Continued)

*Primary Examiner* — Thanh Tam Le
(74) *Attorney, Agent, or Firm* — Thomas A. Turner, Jr.

(57) ABSTRACT

Reconfigurable electrical and electronic communication receptacle boxes are in an assembly that has a face or plurality of faces having electrical and electronic communication receptacles. The faces are recessed from flanges which are mounted on a wall into which the assembly is inserted. The boxes in the assembly are secured to the wall by rotatable clips having a bent or kick to position correctly the clip when rotated. The assembly can be augmented after initial installation with minimal intrusion and destruction of the wall.

9 Claims, 6 Drawing Sheets

(56) References Cited

U.S. PATENT DOCUMENTS

| | | | | |
|---|---|---|---|---|
| 8,449,009 | B1 * | 5/2013 | Bopp | B60K 35/00<br>248/27.1 |
| 9,035,175 | B2 * | 5/2015 | Korcz | H02G 3/086<br>174/50 |

* cited by examiner

RECONFIGURABLE RECESSED ELECTRICAL CONDUIT RECEPTACLES

CLAIM OF PRIORITY UNDER 35 U.S.C., §120

This application is a continuation-in-part application of presently co-pending application Ser. No. 13/423,267 filed Oct. 23, 2012 by Applicant herein Manuel Jose Garcia for HDMI, VGA, COMPONENT, & COAX RECESSED RECEPTACLES. Applicant herein claims all priority rights under Title 35 U.S.C., §120 et seq., for all matter disclosed in said co-pending application

BACKGROUND OF THE INVENTION

Field of the Invention

The present invention relates to the art of electrical and electronic signal conduit receptacles and more particularly to the art of securing and fastening such receptacles against walls and like surfaces.

Description of the Prior Art

In the past, it has been known to provide receptacles for electrical wiring and electronic conduits against walls and like structures. Typically, such receptacles are a terminus of electrical power and are designed to receive electrical wires emanating from electrical appliances to connect the electrical appliance to the electrical power. More recently, such receptacles are the terminus of electronic signals providing complete communication formats such as, for examples, telephony and digital video. The receiving devices, such as video display screens, frequently become part of the furniture of the house or like structure in which the receptacle is located. It is often desired to have such video display screens arranged within the house or structure so as to eliminate or at least hide the connecting wiring, cables or other electronic communication conduits, and to this end receptacles are constructed recessed within walls of the house or like structure, so that the connecting plugs for the electronic communication conduit can be wholly removed from the interior space of the house. Achieving this objective, a display screen can be mounted almost flush against a wall of the house or like structure.

Constructing a recess for such receptacles normally requires re-construction of the wall structure to provide a space for the electrical receptacle boxes. When trying to install a display screen onto an existing wall, constructing an electrical receptacle box within the wall requires substantial destruction of the wall in order to first position the box at the desired location, and then re-constructing the interior of the walls to position electrical conduit shields for shielding the wiring leading to the newly installed box. Such re-construction can become substantial, requiring not only material but also substantial labor time.

It is an object of the present invention to provide an electrical and electronic communication receptacle that can be inserted recessed within a wall of house or like that does not require the usual destruction of the wall and re-construction normally required for installing electrical receptacle boxes. It is a further object of the present invention to provide an electrical or electronic communication conduit receptacle that can be securely inserted into a wall to receive plugs for such electrical and electronic communication conduits while leaving the space out the receptacle completely free so as to allow mounting a display screen flush against the wall immediately adjacent the receptacle. It is yet another and further object of the present invention to provide an electrical and electronic communication receptacle structure that can be modified and augmented to provide additional receptacles without the necessity of installing additional electrical receptacle boxes and the usual attendant destruction of the walls associated with such installations.

SUMMARY

In brief, in accordance with one aspect of the present invention, an electrical and electronic communication receptacle box is provided having a face or receptacle surface recessed or set back from flanges that can be mounted against a wall. The receptacle surface is connected to the flanges by sides, and has on the surfaces the particular receptacles for receiving the particular plugs for the electronic communication devices. The flanges have clips behind the flanges which can be rotated from the front of the flanges for securing the receptacle box against the wall when the box is inserted into a hole formed in the wall. In another aspect of the invention, a plurality of such receptacle boxes is provided, each receptacle box having a different side and flange arrangement so that the plurality of boxes can be assembled together to provide a selectively extendable assembly of receptacle boxes to result in a larger receptacle box structure for a selected multitude of receptacles. The assembly can be changed and augmented if additional receptacles are required when new electronic communication equipment is acquired later.

These and other novel aspects of the present invention, together with other aspects thereof, can be better understood by the following detailed description of the preferred embodiments, which are designed to be read in conjunction and together with the accompanying drawings.

DESCRIPTION OF THE PREFERRED EMBODIMENTS

Figure 1:
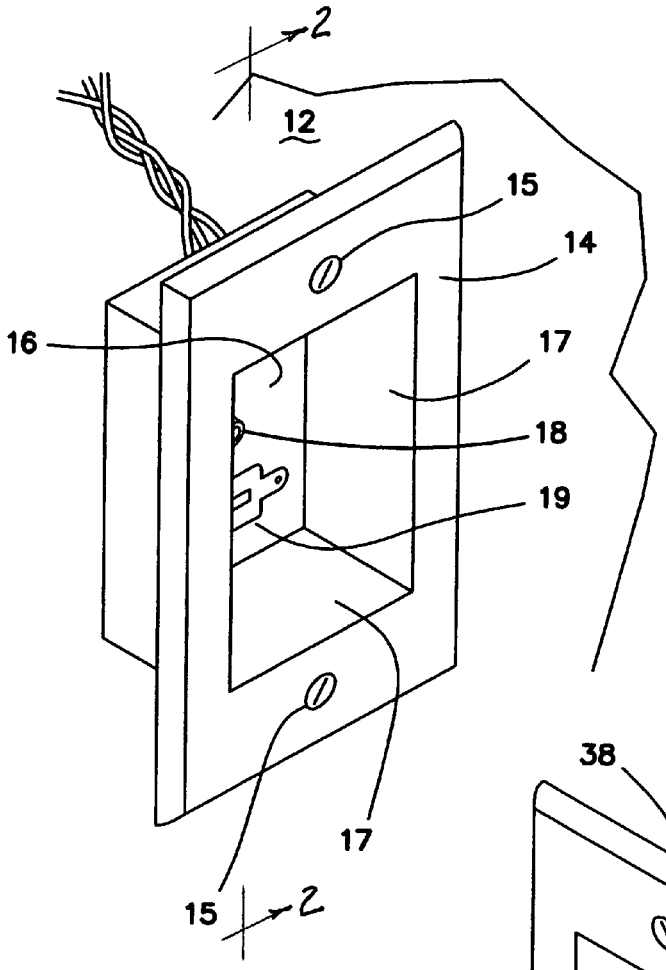
FIG. 1 is a perspective view of a recessed receptacle of the present invention.
Figure 2:
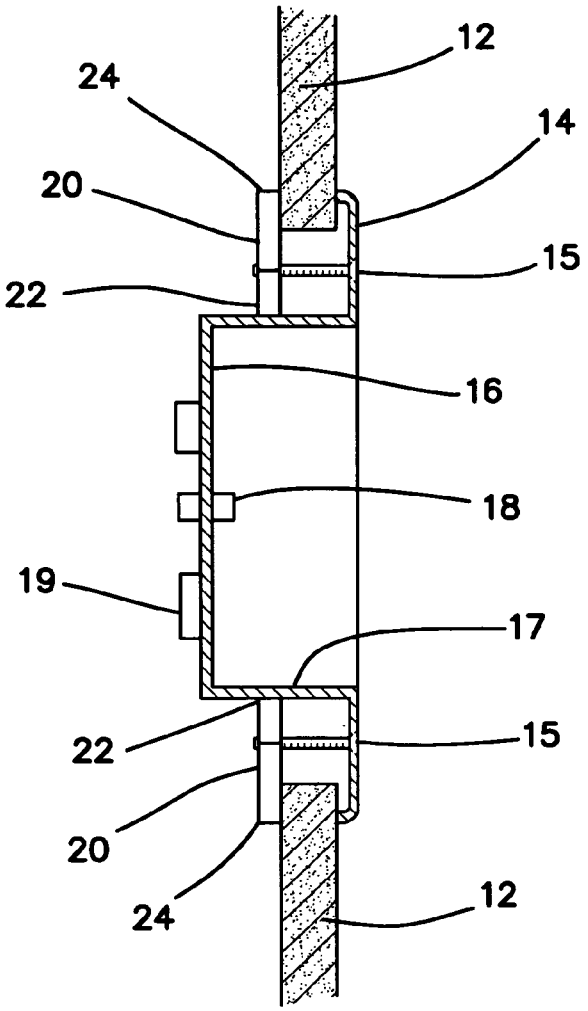
FIG. 2 is a side elevation of the embodiment along line 2-2 of FIG. 1.

An electrical and electronic communication receptacle box 10 adjacent a wall 12 is shown, reference being had initially to FIGS. 1 and 2 of the accompanying drawings wherein reference numerals refer to like numerals used in this specification. The receptacle box 10 has a flange 14 with fasteners 15 provided for firmly holding or fastening the receptacle box 10 to the wall 12, as will be described in greater detail below. The receptacle box 10 has a receptacle surface 16 recessed from the flange 14 and connected to it by sides 17. The receptacle surface 16 has a coaxial cable receptacle 18 and an electrical information conduit receptacle 19, namely a video graphic array ("VGA") receptacle 19.

In FIG. 2, an important detail of the means by which the receptacle box 10 is connected or fastened to the wall 12 is shown. FIG. 2 is a side elevation view taken along line 2-2 of FIG. 1, wherein the receptacle surface 16 is recessed from the flange 14 and connected to the flange 14 by sides 17. The receptacles 18, 19 are then in a position substantially recessed from the plane of the wall 12 so that plugs from connecting conduits will not protrude beyond the wall 12. The fasteners 15, shown partially in broken line, hold the clip 20 to the flange 14. The receptacle 10 is shown positioned within the wall 12. The clips 20 are rotatable about the fasteners 15, and are shown in position so that one end 22 engages the sides 17 while the other end 24 engages the back side of the wall 12 to press the flange 14 and the ends 24 against the wall 12, thus firmly securing the flange 14 to the wall 12.

Slightly off from the axis of rotation of the clip 20 where the fastener 15 is attached to the clip 20, the clip 20 has a bend, sometimes called a kick, of thirty (30) degrees from the general alignment of the clip 20, so that the end 22 of the clip 20 is offset from the general alignment of the clip 20. In this manner, when the clip 20 is rotated about the axis of the fastener 15 ninety degrees, the end 22 will engage the side 17 to prevent further rotation of the clip 20, so that the end 24 of the clip 20 results after rotation in substantially perpendicular alignment relative to the clip's proximal side 17. This perpendicular alignment maximizes the engagement of the end 24 against the wall 12.

Figure 3:
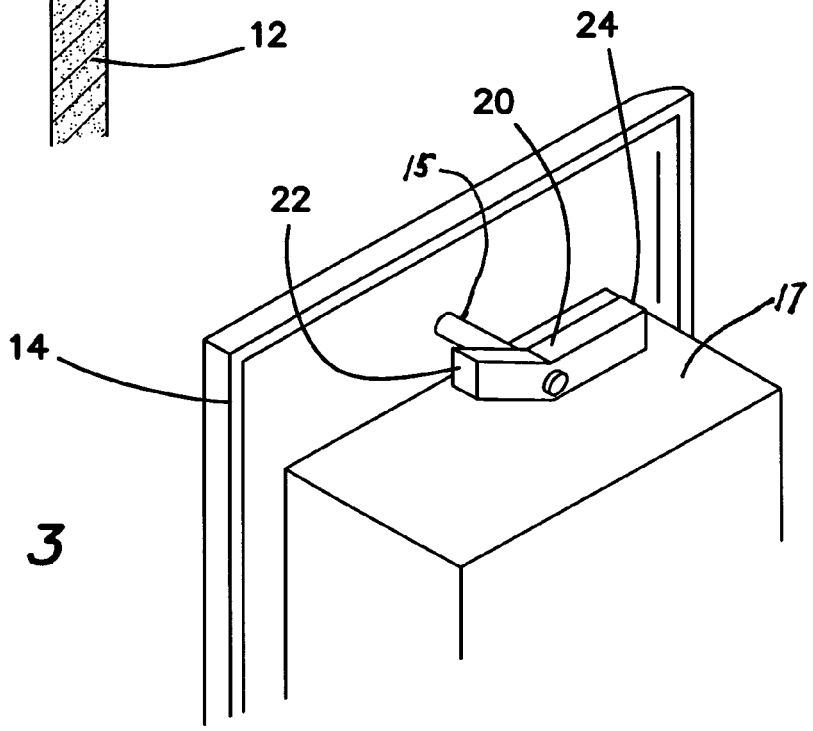
FIG. 3 is a perspective view of a detail of the preferred embodiment of FIG. 1 showing the clip in position prior to installment in a wall.

In FIG. 3, the clip 20 is shown in position prior to the insertion of the receptacle 10 within the wall 12 (as shown in FIG. 2) and prior to the rotation shown in FIG. 2. The rotatable clip 20 is secured to the flange 14 by fastener 15, shown in broken lines because of the angle of the view of FIG. 3. Initially, the clip 20 is parallel to the side 17 nearest or proximal to the clip 20.

In operation, the receptacle 10 is inserted into an opening within the wall 12, with the clip 20 initially in the parallel position shown in FIG. 3. Once the receptacle is inserted within the wall 12, each clip 20 is rotated by turning the fastener 15 ninety degrees, as shown in FIG. 2, so that the flange 14 and the end 24 of each clip 20 presses against the wall 12 to secure the receptacle 10 to the wall 12. Each clip 20 is firmly stabilized in its position shown in FIG. 2 by the stop provided by the end 22 having a kick against the side 17 of the receptacle 10.

Figure 4:
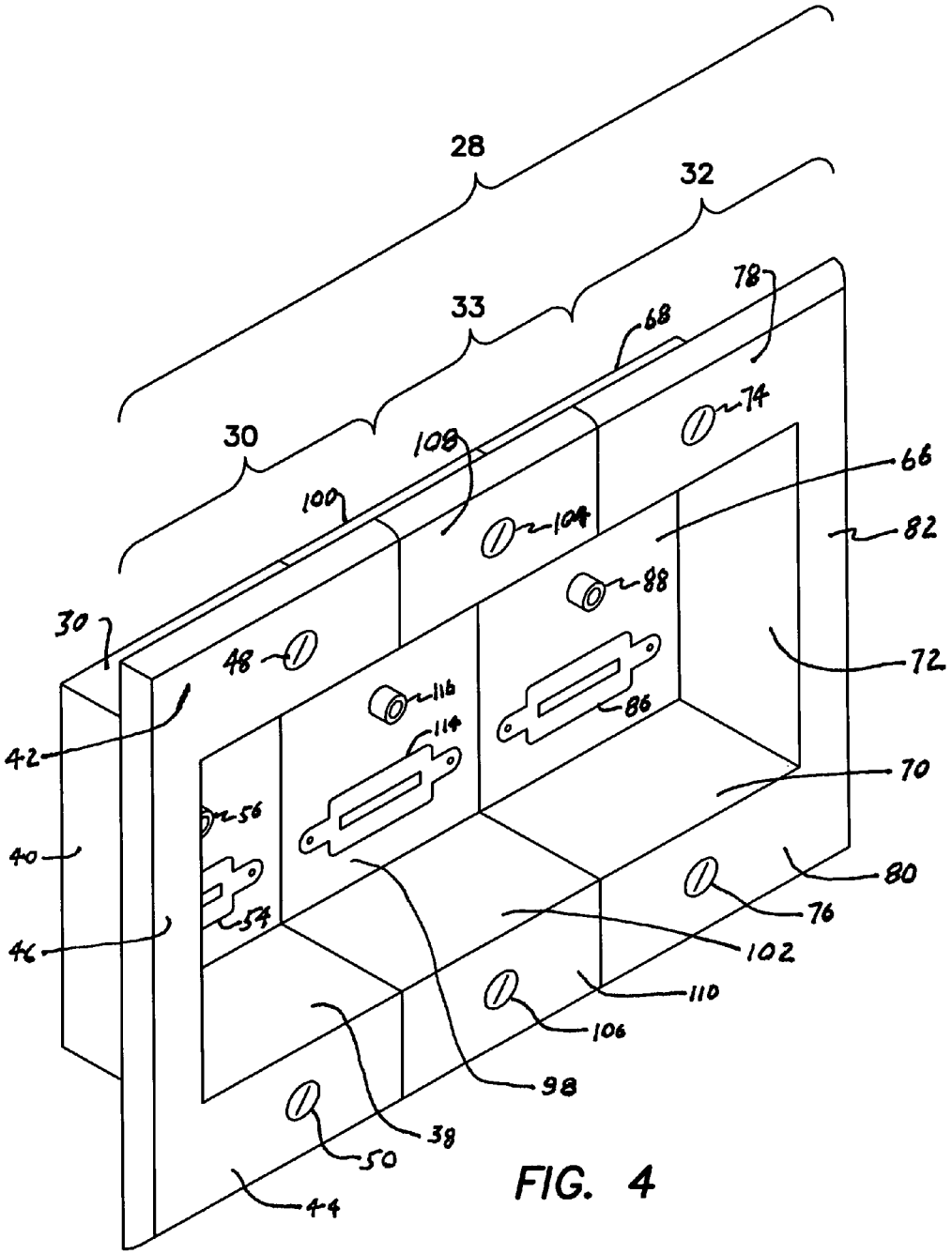
FIG. 4 is a perspective view of a preferred embodiment of the present invention, showing multiple receptacle boxes ganged to provide increased capacity.

In FIG. 4, a wall receptacle assembly 28 is shown depicting certain aspects of the present invention. Receptacle box 30 is shown ganged with receptacle box 32 and receptacle box 33 to create an expanded area for the recessed surfaces 34, 66, 98. The recessed surfaces 34, 66, 98 are positioned recessed from their corresponding flanges 42, 44, 46, 78, 80, 82, 108, 110 by sides 38, 40, 70, 72, 102 and other sides not seen in the view of FIG. 4. In FIG. 4 are also shown the heads of the fasteners 48, 50, 74, 76, 104, 106 which hold and fasten the clips 20, not shown in this view. Various receptacles 56, 54, 86, 88, 114, 116 may be seen in this view, as well. All of these features will be described in greater detail below, and are shown in this FIG. 4 merely to show the relative positions of the receptacle boxes 30, 32, 33 in the assembly 28.

Figure 5:
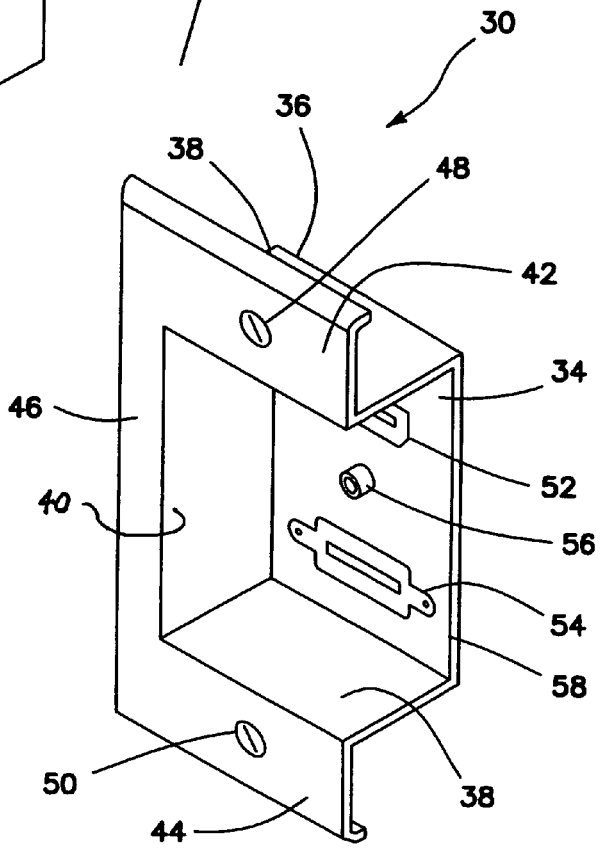
FIG. 5 is a perspective view of one receptacle box showing details of an end box for an assembly.

In FIG. 5, the receptacle box 30 is seen having a surface 34. The surface 34 is formed connected by a first side 36 to a first flange 42, by a second side 38 to a second flange 44, and by a third side 40 to a third flange 46. The box 30 has a contiguous edge 58 to the surface 34, sides 36, 38, and flanges 42, 44. Fasteners 48, 50 secure the receptacle box 30 to a wall 12, in much the same manner as described for the embodiment of FIGS. 1, 2. Recessed surface 34 is substantially parallel with the flanges 42, 44, 46, and contains an electrical information conduit receptacle 52 for a high definition multimedia interface ("HDMI"), an electrical information conduit receptacle 54 for a video graphic array ("VGA"), and a signal cable conduit receptacle 56 for a cable.

Figure 6:
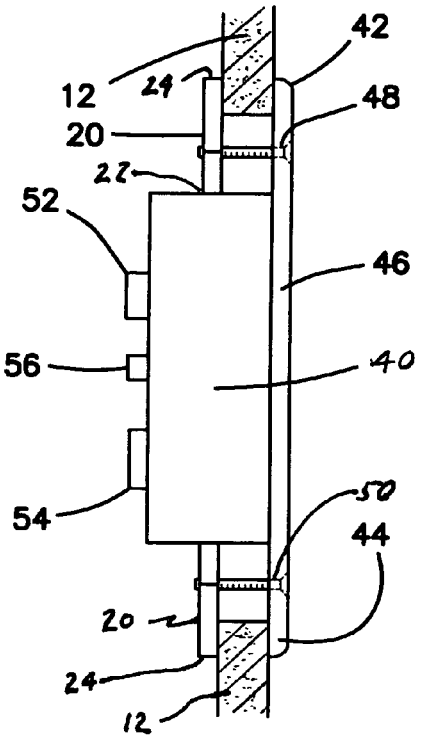
FIG. 6 is side elevation view of the receptacle box of FIG. 5.

A side elevation of the receptacle box 30 is seen in FIG. 6, where the side 40 and the flanges 42, 44, 46 are seen in elevation. In this view, the connecting means for connecting the receptacle box 28 to the wall 12 is seen in greater detail. A clip 20 is held to flange 42 by fastener 48, and another clip 20 is held to flange 44 by fastener 50. The clips 20 have been rotated ninety degrees so that the ends 22 with their kick engage respective sides 36, 38. The ends 24 of the clips 20 engage the wall 12 so as to hold firmly the flanges 42, 44 to the wall 12. Receptacles 52, 54, 56 protrude to the rear of the box 30.

Figure 8:
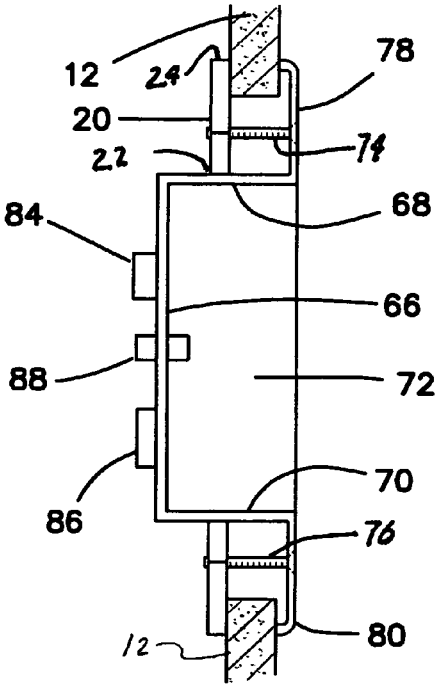
FIG. 8 is a side elevation view of the receptacle box of FIG. 7.
Figure 7:
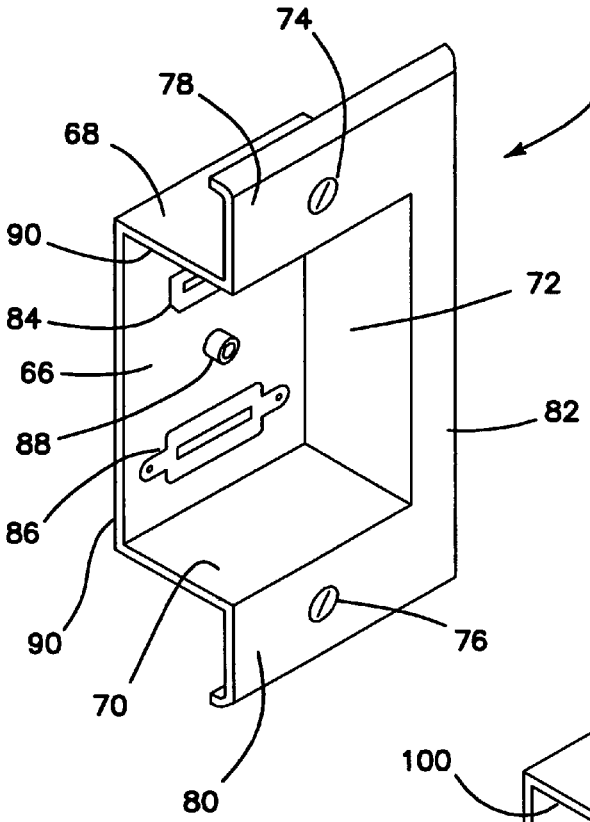
FIG. 7 is a perspective view of a second receptacle box showing detail of an end box complemental to the end box of FIG. 5.

A complemental second receptacle box 32 is seen in the views of FIGS. 7 and 8, where FIG. 7 is a perspective view of the box 32, and FIG. 8 shows the box 32 in side elevation to present the wall connecting means in better detail. The second receptacle box 32 has a second recessed surface 66 with a fourth side 68 connecting the surface 66 to a fourth flange 78, a fifth side 70 connecting the surface 66 to fifth flange 80, and a sixth side 72 connecting the surface 66 to sixth flange 82. Rotatable fastener 74 holds a clip 20, and rotatable fastener 76 holds another clip 20 to the box 32. The surface 66 contains an HDMI receptacle 84, a VGA receptacle 86 and a cable receptacle 88. The receptacle box 32 has a box open edge 90 defined by the surface 66, sides 68, 70 and flanges 78, 80. In these views of FIGS. 7, 8, the clips 20 are rotated ninety degrees to cause their ends 22 to engage with their kicks the sides 68, 70 and the ends 24 to engage the wall 12 to firmly secure the receptacle 32 to the wall 12.

Figure 10:
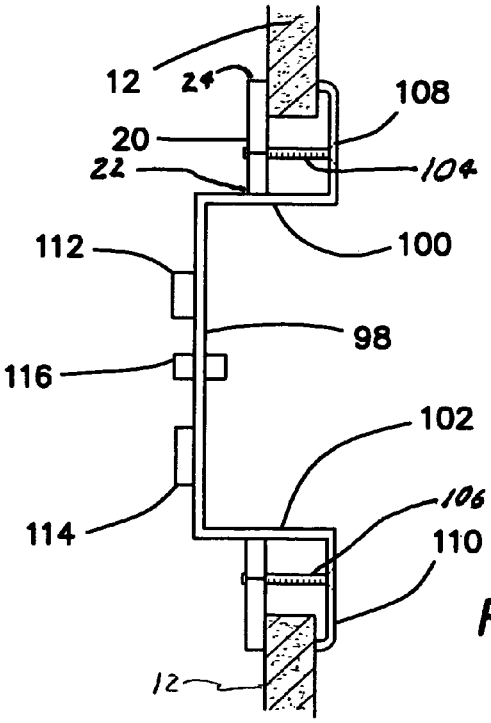
FIG. 10 is a side elevation view of the receptacle box of FIG. 9.
Figure 9:
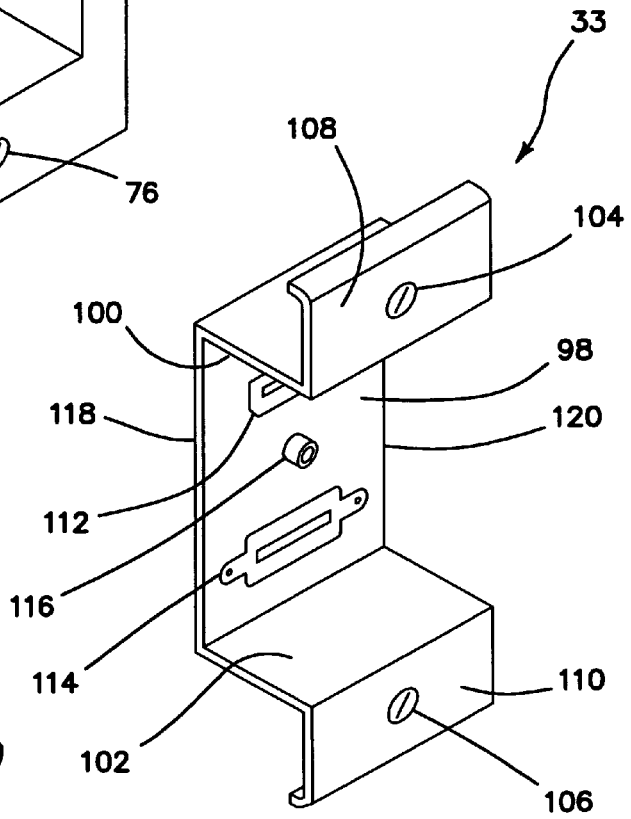
FIG. 9 is a perspective view of a third receptacle box showing detail of an intermediary box of the preferred embodiment of the present invention.

A third receptacle box 33 is seen in the views of FIGS. 9 and 10, where FIG. 9 is a perspective view of the box 33, and FIG. 10 shows the box 33 in side elevation to present the wall connecting means in better detail. The third receptacle box 33 has a third recessed surface 98 with a seventh side 100 connecting the surface 98 to a seventh flange 108, and an eighth side 102 connecting the surface 98 to eighth flange 110. Rotatable fastener 104 holds a clip 20, and rotatable fastener 106 holds another clip 20 to the box 33. The surface 98 contains an HDMI receptacle 112, a VGA receptacle 114 and a cable receptacle 116. The receptacle box 33 has two box open edges 118, 120. In particular, a third receptacle box left edge 118 is seen on the left of the contiguous surface 98, sides 100, 102 and flanges 108. In like manner, a third receptacle box right edge 120 is seen on the right of the contiguous surface 98, sides 100, 102 and flanges 108, 110. Again, in these views of FIGS. 9, 10, the clips 20 are rotated ninety degrees to cause their ends 22 with their kicks to engage their corresponding sides 100, 102, and their ends 24 to engage the wall 12 to firmly secure the receptacle 33 to the wall 12.

In operation, a hole is made in a wall 12 adequate to accept the number of receptacle boxes that may be desired. For an example, one option may be to establish six receptacles. For such an installation, only two of the receptacle boxes 30, 32 may be needed. To accomplish such an installation, one may take receptacle box 30 and the receptacle box 32 and hold them together, the first receptacle box open edge 58 being placed in alignment with, and abutting the second receptacle open edge 90, and the combination inserted into the wall 12. While the boxes 30, 32 are being inserted into the wall, the clips 20 are in the position seen in FIG. 3, substantially parallel to their corresponding proximal sides 36, 38, 68, 70. After the boxes 30, 32 are inserted into the wall 12, the clips 20 are rotated ninety degrees, so their ends 22 engage their corresponding proximal sides 36, 38, 68, 70; and the ends 24 of the clips 20 engage the wall 12 to firmly secure the receptacle boxes 30, 32 to the wall 12.

In another variation of substantially the same embodiment, additional receptacles can be made available for additional multi-media connections. Thus, as best seen in FIG. 4, a third receptacle box 33 is added to the assembly 28. The first receptacle box 30 and the second receptacle box 32 are inserted into the wall 12, but a space is left between the two. The hole in the wall 12 must, of course, be made large enough to accept three of the receptacle boxes. The third receptacle box 33 will be of the form seen in FIGS. 9 and 10, so that the third receptacle box left edge 118 is joined and aligned with the first receptacle box edge 58, and the third receptacle box right edge 120 is joined and aligned with the second receptacle box edge 90. Fasteners 104, 106 will hold their respective clips 20 in parallel with their corresponding sides 100, 102 while the third receptacle box 33 is inserted into the wall 12. After the receptacle boxes 30, 32, 33 are inserted into the wall 12, the fasteners 104, 106 are rotated ninety degrees, as are the fasteners 48, 50 and 74, 76, all to have the clip ends 22 with their kicks to engage their corresponding proximal sides 100, 102 for the third box 33, proximal sides 36, 38 for the first box 30, and proximal sides 68, 70 for the second box 32. At the same time, the clip ends 24 will engage the wall 12 to hold their corresponding flanges 42 46, 78, 82, 18, 110 firmly against the wall 12 and thus secure the receptacle boxes 30, 32, 33 in ganged array within the wall 12, as shown in FIG. 4.

Figure 11:
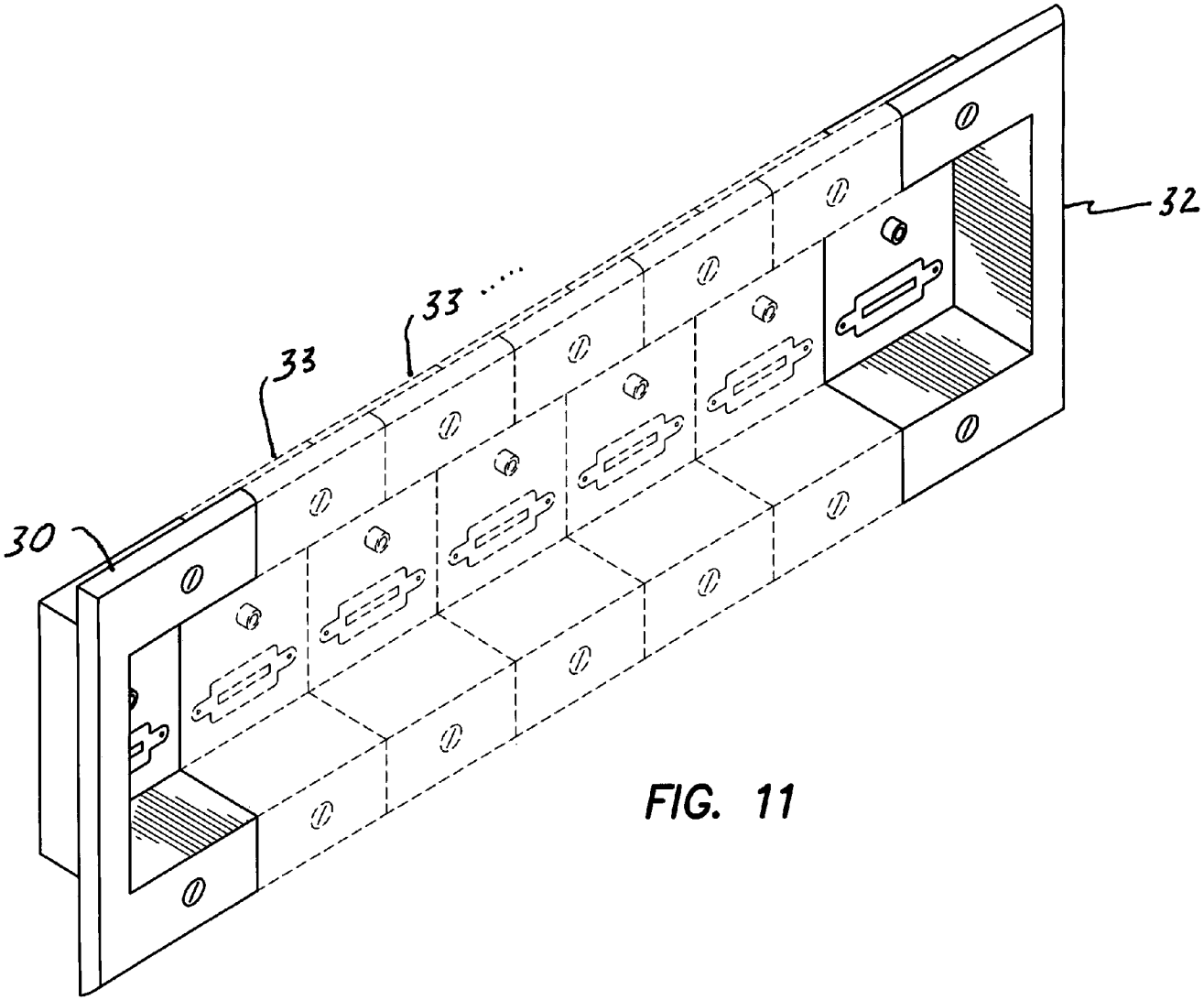
FIG. 11 is a perspective view of an assembly of indeterminate receptacle boxes of the preferred embodiment of the present invention.

It will now be appreciated also by those skilled in the art that any number of additional receptacle boxes of a structure like the third receptacle box 33 can be ganged to the provided any number of receptacles as may be desired for any given installation, as representatively shown in phantom in FIG. 11. Furthermore, after an initial installation of two or three receptacle boxes such as receptacle boxes 30, 32 and 33 in assembly 28, the configuration can be modified or re-configured to accept additional boxes. In such event, the connecting fasteners 48, 50, 74, 76, 104, 106 can be rotated in reverse to release their corresponding boxes 30, 32, 33 from their secured position to the wall 12. The hole in the wall 12 can then be augmented so that additional intermediary receptacle boxes like receptacle box 33 can added to the gang. Any number of such additional boxes can be added to the gang as representatively illustrated in FIG. 11.

By these foregoing arrangements, it may be seen that the receptacle boxes 30, 32 and as many intermediary boxes similar to receptacle box 33 as desired, can be inserted into a wall 12 and secured to the wall firmly and securely without the necessity of installing an electrical box of the more traditional kind. Eliminating this requirement greatly streamlines the installation process. Importantly, the present invention provides a more simple process for creating electrical and electronic communication receptacles in adequate quantity at a new and desired location on existing walls within a house. Wall display screens now commonly acquired for home entertainment and multi-media systems can now be located and positioned anywhere where the wall space allows and interior decoration suggests, and electronic communication receptacles can be located within the wall adjacent the rear of such screens and hidden from normal view by the screen itself, without the necessity of constructing conventional electrical boxes. Moreover, in the event that conventional electrical boxes are available or desired for any reason, the clips 20 can be selectively removed merely by removing fasteners 15, 48, 50, 74, 76, 104, 106. The receptacle boxes 30, 32 or even receptacle box 33 can then be inserted into the electrical box.

The foregoing detailed description of my invention and of preferred embodiments as to products, compositions and processes, is illustrative of specific embodiments only. It is understood, however, that additional embodiments may be perceived by those skilled in the art. The embodiments described herein, together with those additional embodiments, are considered to be within the scope of the present invention.

I claim:

1. A wall receptacle assembly for receiving at least one electrical information conduit and mountable to a wall, comprising a plurality of contiguously ganged receptacle boxes, including a first receptacle box comprising:

a. a first receptacle surface having at least one electrical information conduit receiving receptacle;

b. at least a first side and a second side extending parallel to each other and forward from said first receptacle surface;

c. a first flange and a second flange extending from corresponding said first and said second sides, each said flange being substantially parallel to said first receptacle surface; and, d. first connecting means on at least a selected one of said first flange and said second flange, for connecting said at least selected one flange to said wall, said first connecting means comprising a clip rotatably held to said selected one flange such that when said clip is rotated, said clip holds said selected one flange against the wall positioned between said clip and said one selected flange, wherein said clip is selectively rotatable.

2. The wall receptacle assembly of claim 1 wherein said clip comprises a first end having a kick and a second end, said first end having an angle to said second end of less than 180 degrees, and said clip with its ends being rotatable about a fastener holding said clip to said selected one flange, and wherein when said clip is rotated said first end with the kick abuts one of said sides and said second end engages a side of said wall positioned between said clip and said selected one flange.

3. The wall receptacle assembly of claim 2 wherein said clip is rotatable from a side of said wall opposite from said clip.

4. The wall receptacle assembly of claim 1 wherein said first receptacle box further comprises:

a. a third side extending forward from said first receptacle surface, said third side being connected to said first side along a first edge of said third side, and being connected to said second side along an opposing second edge of said third side;

b. a third flange extending from said third side substantially coplanar with said first and said second flanges; and, c. opening means for joining said first receptacle box with another of said plurality of ganged receptacle boxes, said opening means including an opening defined by a contiguous edge of said first side, said second side and said first receptacle surface.

5. The wall receptacle assembly of claim 4 further comprising a second receptacle box comprising:

a. a second receptacle surface having at least one electrical information conduit receiving receptacle;

b. at least a fourth side and a fifth side extending parallel to each other and forward from said second receptacle surface;

c. a fourth flange and a fifth flange extending from corresponding said fourth side and said fifth side, each of said fourth and said fifth flanges being substantially parallel to said second receptacle surface; and, d. second connecting means on at least a selected one of said fourth flange and said fifth flange, for connecting at least said second selected one flange to said wall, said second connecting means comprising a second clip rotatably held to said second selected one flange such that when said second clip is rotated, said second clip holds said second selected one flange against the wall positioned between said second clip and said second selected one flange, wherein said second clip is selectively rotatable.

6. The wall receptacle assembly of claim 5 wherein said Second receptacle box further comprises:

a. a sixth side extending forward from said second receptacle surface, said sixth side being connected to said fourth side along a first edge of said sixth side, and being connected to said fifth side along an opposing second edge of said sixth side;

b. a sixth flange extending from said sixth side substantially coplanar with said fourth and said fifth flanges; and, c. second opening means for joining said second receptacle box with said first receptacle box, said opening means including an opening defined by a contiguous edge along said fourth side, said fifth side and said second receptacle surface, whereby the surface of the ganged receptacle boxes is augmented to have more electrical conduit receiving receptacles.

7. The wall receptacle assembly of claim 5 further comprising a third receptacle box comprising:

a. a third receptacle surface having at least one electrical information conduit receiving receptacle;

b. at least a seventh side and an eighth side extending parallel to each other and forward from said third receptacle surface;

c. a seventh flange and an eighth flange extending from corresponding said seventh side and said eighth side, each of said seventh flange and said eighth flange being substantially parallel to said third receptacle surface;

d. third opening means for joining said third receptacle box with said first receptacle box, said opening means including a third opening defined by a contiguous edge of said seventh side, said eighth side and said third receptacle surface, said third opening being shaped to join said first opening;

e. fourth opening means for joining said third receptacle box with said second receptacle box, said opening means including a fourth opening defined by a contiguous edge of said seventh side, said eighth side and said third receptacle surface, said fourth opening being shaped to loin said second opening and, f. third connecting means on at least a selected one of said seventh flange and said eighth flange, for connecting said third selected one flange to said wall, said third connecting means comprising a third clip rotatably held to said third selected one flange such that when said third clip is rotated, said third clip holds said third selected one flange against the wall positioned between said third clip and said third selected one flange, wherein said third clip is selectively rotatable, whereby the surface of the ganged receptacle boxes is augmented to have more electrical conduit receiving receptacles.

8. The wall receptacle assembly of claim 7 wherein said assembly comprises a plurality of said third receptacle boxes.

9. A wall receptacle assembly for receiving at least one electrical information conduit and mountable to a wall comprising a receptacle box comprising:

a. a first receptacle surface having at least one electrical information conduit receiving receptacle;

b. at least a first side and a second side extending parallel to each other and forward from said first receptacle surface;

c. a first flange and a second flange extending from corresponding said first and said second sides, each said flange being substantially parallel to said first receptacle surface; and, d. connecting means on at least a selected one of said first flange and said second flange, for connecting said at least selected one flange to said wall, said first connecting means comprising a clip rotatably held to said selected one flange such that when said clip is rotated, said clip holds said selected one flange against the wall positioned between said clip and said one selected flange, wherein said clip comprises a first end having a kick and a second end, said first end having an angle to said second end of less than 180 degrees, and said clip with its ends being rotatable about a fastener holding said clip to said selected one flange, and wherein further when said clip is rotated said clip engages a side of said wall positioned between said clip and said selected one flange, and said kick abuts and is stopped by one of said flanges.

* * * * *